US006408926B1

(12) United States Patent
Hoofard et al.

(10) Patent No.: US 6,408,926 B1
(45) Date of Patent: Jun. 25, 2002

(54) SECTIONAL DOOR REINFORCEMENT SYSTEM AND METHOD

(75) Inventors: Richard K. Hoofard, Dallas; Ted Lefkovits, Richardson; Michele Rene Womack, Carrollton, all of TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/705,972

(22) Filed: Nov. 3, 2000

(51) Int. Cl.[7] ..... E05D 15/26
(52) U.S. Cl. ..... 160/236; 160/201
(58) Field of Search ..... 160/201, 209, 160/229.1, 232, 236, 207, 405; 52/291

(56) References Cited

U.S. PATENT DOCUMENTS

| | | | | |
|---|---|---|---|---|
| 3,516,474 A | | 6/1970 | Pemberton et al. | |
| 3,853,166 A | | 12/1974 | Wrono | |
| 4,918,890 A | * | 4/1990 | Stafford | 52/291 |
| 4,934,439 A | | 6/1990 | Martin | |
| 5,205,096 A | * | 4/1993 | Pace | 52/291 X |
| 5,383,509 A | | 1/1995 | Gaffney et al. | |
| 5,445,207 A | | 8/1995 | Romanelli et al. | |
| 5,588,270 A | * | 12/1996 | Keating | 52/291 |
| 5,706,877 A | | 1/1998 | Grisham et al. | |
| 5,732,758 A | * | 3/1998 | Marko | 160/201 |
| 5,749,407 A | | 5/1998 | Brenner et al. | |
| 5,819,834 A | | 10/1998 | Wedekind | |
| 5,896,724 A | | 4/1999 | Tofts | |
| 5,964,269 A | * | 10/1999 | Decola | 160/209 |
| 6,062,293 A | | 5/2000 | Berger, Jr. | |
| 6,082,429 A | | 7/2000 | Ochoa | |
| 6,082,431 A | | 7/2000 | Decola | |
| 6,161,606 A | | 12/2000 | Wegner et al. | |

* cited by examiner

*Primary Examiner*—David M. Purol
(74) *Attorney, Agent, or Firm*—Gardere Wynne Sewell LLP

(57) ABSTRACT

Sectional garage door panels are provided with elongated reinforcing beams secured to the inside surface of the panels by supporting a beam on a panel with spaced apart support brackets secured to the panel and securing the beam to the panels at spaced apart points thereon with mechanical fasteners. The beams are preferably channel shaped and the support brackets each include a beam locating projection for accurately locating the beams on a panel and in engagement with panel reinforcing stiles to facilitate quickly securing the beams to the panel with mechanical fasteners. The panels are erected in a doorway and supported by opposed guide tracks prior to installing the beams on the panel to facilitate handling the panels and the beams during shipment and prior to installation. The reinforcing system may be retrofitted to existing door panels or shipped with new doors to sites where expected wind load conditions favor adding reinforcement to lightweight folded metal or extruded or fabricated plastic sectional doors, particularly residential garage doors and the like.

16 Claims, 8 Drawing Sheets

SECTIONAL DOOR REINFORCEMENT SYSTEM AND METHOD

FIELD OF THE INVENTION

The present invention pertains to a sectional garage door including a windload reinforcement beam system for one or more of the door sections or panels and a method of installing such reinforcement beams.

BACKGROUND

Sectional doors and sectional upward acting doors, in particular, present unique engineering requirements. Typically, sectional upward acting garage doors are required to be of lightweight construction while also being required to provide a sturdy closure over a relatively large opening in a vertical wall. One longstanding problem associated with sectional garage doors pertains to the so called windload capability of the door in its closed position, that is the ability to withstand pressure forces acting on the door both inwardly and outwardly due to ambient winds. The ability to withstand expected windloads in door applications wherein long term climate conditions may be changing to frequent aggravated windload conditions, or where expected wind loads are already well known, not only requires new door installations to meet the windload requirements but retrofitting existing doors also presents a problem in the art. Although many sectional garage doors are fabricated of lightweight formed or extruded metal or plastic panels, these panels may not be suitably reinforced against high windloads during fabrication in order to facilitate shipping, handling, to permit storing the panels one on top of the other and to provide the installed weight of the door within door operator power limits. Moreover, the longitudinal or spanwise dimensions of sectional garage doors present a problem in reinforcing the door panels against bending along their longitudinal axes under windloads as well as other operating conditions.

Certain efforts have been attempted to provide longitudinal reinforcing beams mounted on sectional door panels. However, the additional weight provided by these beams aggravates installation procedures and prior art methods of installing beams on door panels after the panels are installed in their working positions also present problems and require extra time and personnel to hold the beams in place while they are fastened to the door panels.

Accordingly, there has been a need to provide an improved door panel reinforcing beam system for sectional doors and a method of installing such beams. It is to these ends that the present invention has been developed.

SUMMARY OF THE INVENTION

The present invention provides an improved reinforcing beam system for sectional garage door panels including, in particular, garage door panels for upward acting sectional garage doors.

The present invention also provides an improved method of installing reinforcing beams on sectional garage door panels and the like.

In accordance with one aspect of the present invention sectional garage door panels and the like are reinforced by installing longitudinally oriented lightweight beam members on one or more panels of a sectional garage door. The beams are preferably secured to vertical spaced apart stiles or other reinforcing members comprising conventional structural elements of sectional garage door panels. In addition, two or more support brackets are mounted on the sectional garage door panels to support the beam, or beams, respectively. The beams and the brackets may be separately secured to the garage door panels by conventional threaded fasteners and the like. The configurations of the support brackets aid in locating the beams as well as resisting bending and twisting loads imposed on the beams, respectively. Spaced apart gussets may be included as reinforcing members to resist deflection of channel shaped beams, in particular. Various beam cross section configurations are contemplated, such as channels, so-called C-channels, I beams or H beams, box beams and other tubular (cylindrical and otherwise) beams.

In accordance with another aspect of the invention, an improved method of installing reinforcing beams on sectional garage door panels and the like is provided. Door panels may be reinforced by installing beams thereon while the panels are in their working positions extending across a door opening and otherwise supported by conventional door guide structure. The improved method alleviates the problems associated with handling door panels which have had heavy beam elements preinstalled before the door panels themselves are installed in the door opening. The beam system and method of installation are particularly advantageous for doors which are already installed in door openings.

Those skilled in the art will further appreciate the above-mentioned advantages and superior features of the invention together with other important aspects thereof upon reading the detailed description which follows in conjunction with the drawings.

DETAILED DESCRIPTION OF PREFERRED EMBODIMENTS

Figure 1:
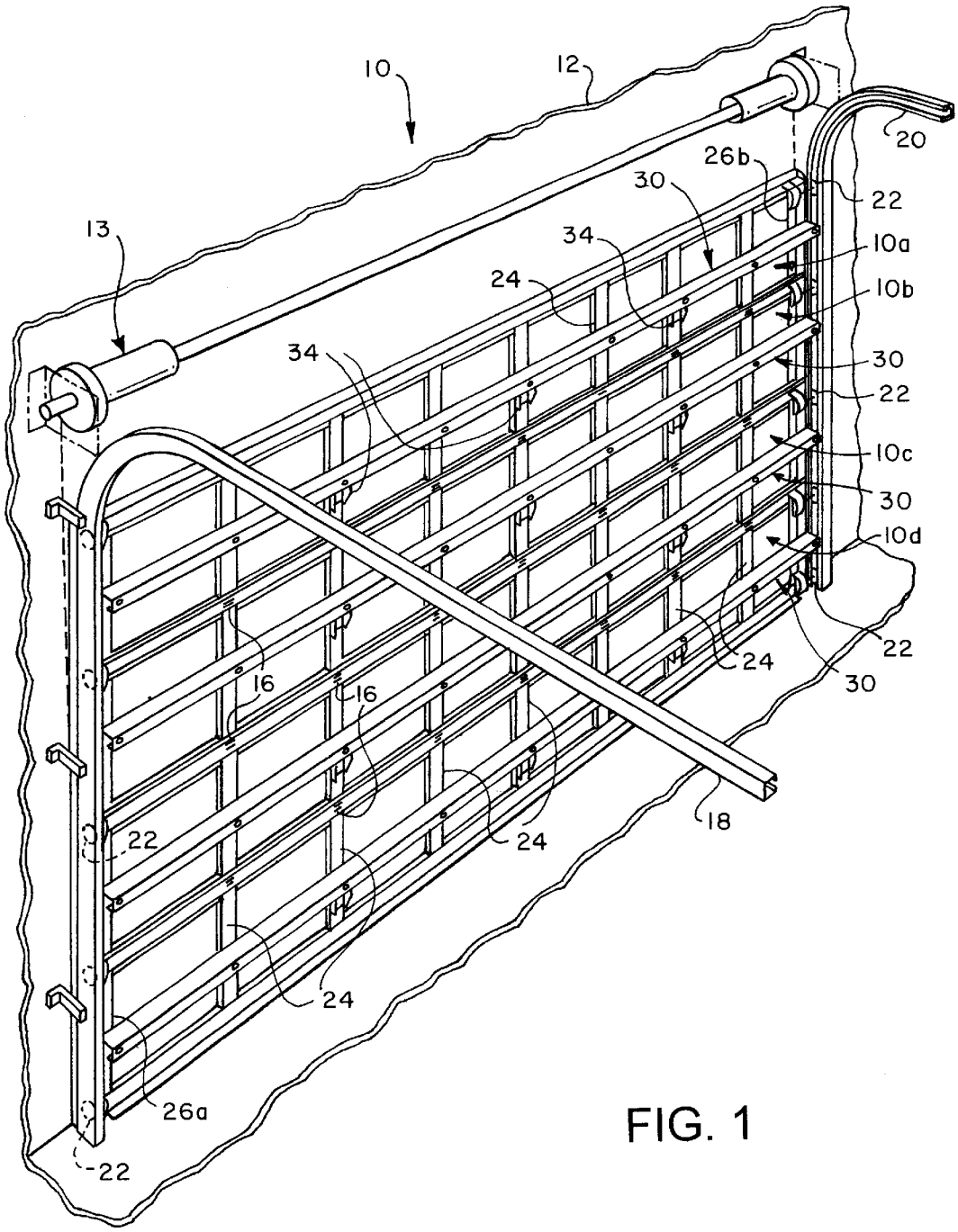
FIG. 1 is a perspective view of a sectional upward acting garage door shown in its closed position and including the improved reinforcing beam system of the present invention.

In the description which follows like elements are marked throughout the specification and drawings with the same reference numbers, respectively. The drawing figures may not be to scale in the interest of clarity and conciseness.

Referring to FIG. 1, there is shown a sectional upward acting door which has been modified in accordance with the present invention and is generally designated by numeral 10. The door 10 is characterized by plural generally rectangular sections or panels 10*a*, 10*b*, 10*c* and 10*d* which are stacked vertically on top of each other in the door closed position forming a closure over an enlarged opening in a wall 12, in a known manner. The door sections or panels 10*a*, 10*b*, 10*c* and 10*d* are interconnected by spaced apart sets of hinges 16 which may be configured similar to the hinges disclosed in U.S. patent application Ser. No. 09/570,618, filed May 15, 2000 by L. Blake Whitley and assigned to the Assignee of the present invention. The subject matter of U.S. patent application Ser. No. 09/570,618 is incorporated herein by reference in its entirety. The door panels 10*a*, 10*b*, 10*c* and 10*d* are guided, collectively, for movement between the closed position shown in FIG. 1 and an open position by spaced apart guide members comprising, by way of example, channel shaped tracks 18 and 20. Spaced apart door guide members 22 are preferably mounted on the respective door panels 10*a*, 10*b*, 10*c* and 10*d* and are operable to support the door 10 for movement between open and closed positions guided by the tracks 18 and 20 in a generally known manner. The weight of the door 10 may be counterbalanced by a suitable counterbalance mechanism 13, FIG. 1.

As will be explained in further detail herein, each of the door panels 10*a*, 10*b*, 10*c* and 10*d* may be formed of relatively thin folded metal sheet, extruded metal sheet, or molded or extruded plastic, for example. For the sake of discussion herein the panels 10*a*, 10*b*, 10*c* and 10*d* are formed of folded metal having a configuration explained in further detail herein in conjunction with the description of the structure shown in FIGS. 5 and 6 of the drawings. The sheet metal panels 10*a*, 10*b*, 10*c* and 10*d* are reinforced against bending along their transverse axes (vertically extending axes in the door closed position shown in FIG. 1) by spaced apart vertically extending reinforcing members or stiles 24. The number of stiles shown for the panels 10*a*, 10*b*, 10*c* and 10*d* is seven intermediate stiles 24 and two opposed end stiles 26*a* and 26*b*, respectively, for each panel. The stiles 24 are preferably folded metal or plastic column members and are suitably secured to each of the panels 10*a*, 10*b*, 10*c* and 10*d* in a known manner.

Apart from the specific configuration of the panels 10*a*, 10*b*, 10*c* and 10*d*, sectional doors formed of relatively thin walled panels which are formed of folded, extruded or otherwise formed metals and plastics are typically provided with opposed end stiles and a set of intermediate stiles which may vary in number in accordance with the length or span of the respective door panels. Such door panels may vary in length from about eight feet to twenty feet, and may have a width of about two to three feet, for example. Accordingly, the panels 10*a*, 10*b*, 10*c* and 10*d* are suitably reinforced by the stiles 24, 26*a* and 26*b* against bending along their transverse axes but are susceptible to bending along their longitudinal axes, respectively. However, in applications of such doors which do not require substantial reinforcement against wind loading and the like the panels are of adequate strength without any additional structural reinforcement. Certain so-called insulated door panels, not shown, which have a polymer foam filling between the upper and lower edges and the opposed side edges of the panel may be provided and such panels have somewhat greater strength with respect to bending along their longitudinal axes. In all events, the present invention is directed to sectional door panels for upward as well as horizontally acting doors including panels which may have insulation type panel reinforcement or may not.

The present invention contemplates that at least one and preferably all of the panels 10*a*, 10*b*, 10*c* and 10*d* for the door 10 be reinforced against bending with respect to their longitudinal axes by respective elongated beams 30, one each shown for each panel 10*a*, 10*b*, 10*c* and 10*d*. The beams 30 are also, on each panel, secured to at least selected ones of the stiles 24, 26*a* and 26*b*.

Figure 2:
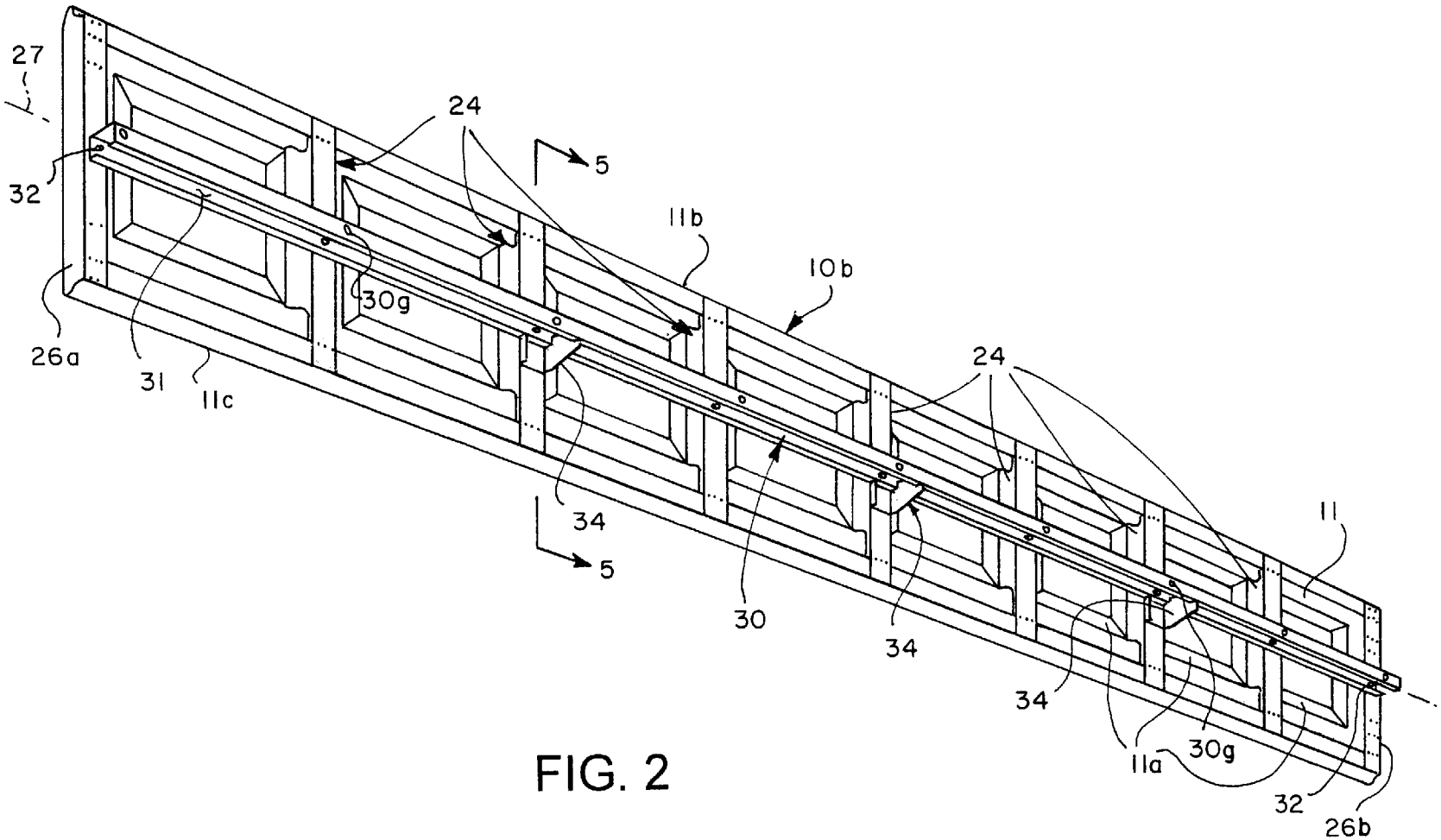
FIG. 2 is a view of one of the garage door sections or panels for the door shown in FIG. 1, from a different perspective and showing a reinforcing beam installed together with its support brackets.
Figure 3:
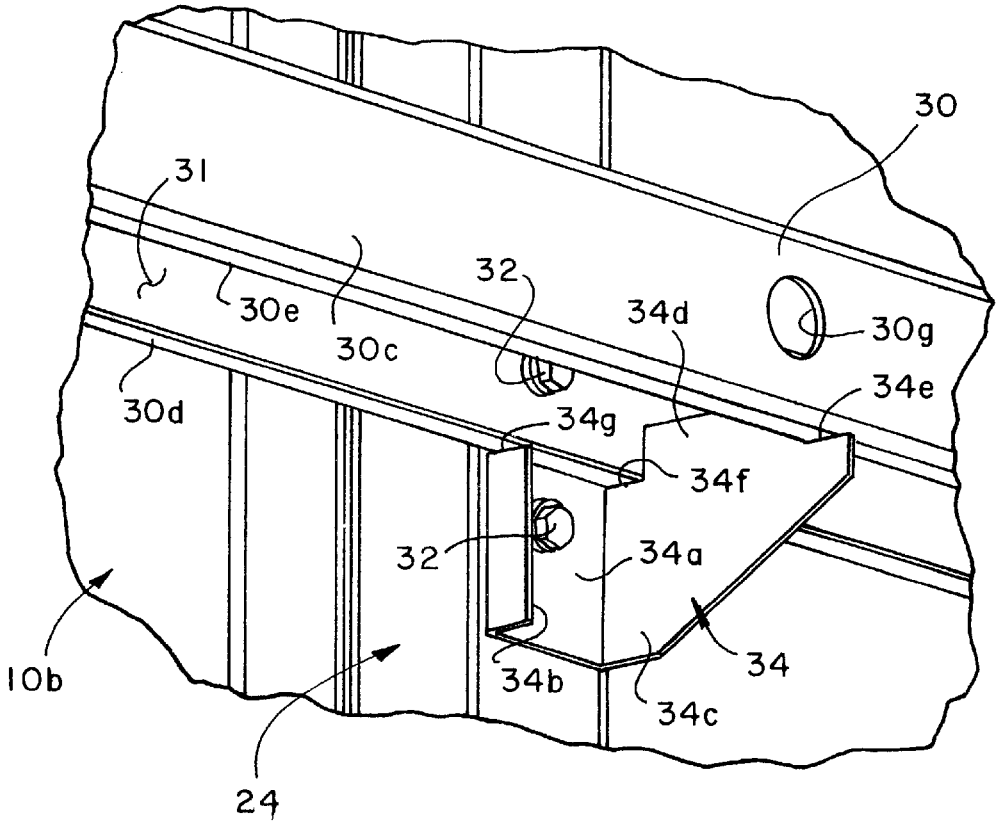
FIG. 3 is a detail perspective view taken generally from the same perspective as FIG. 2 but on a larger scale.
Figure 4:
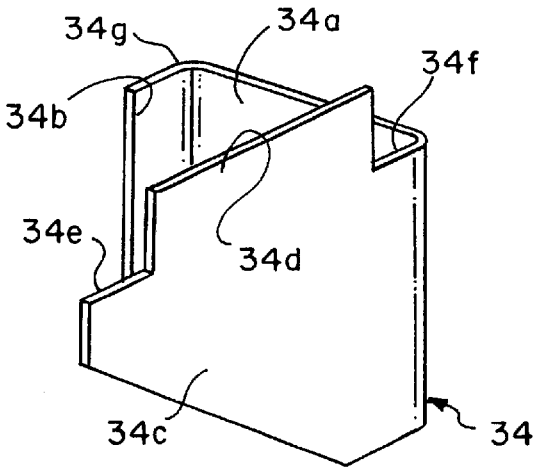
FIG. 4 is a perspective view, from another angle of one of the support brackets for the support beam system.

Referring now to FIGS. 2, 3 and 4, the panel 10*b* is shown by way of example. The panel 10*b* includes a longitudinal axis 27 and may be embossed along its front or outer wall 11 to add some rigidity to the wall. The configuration of the embossing is shown as a series of generally rectangular outwardly extending depressions 11*a*, respectively, spaced apart along the length of the panel 10*b*. The stiles 24, 26*a* and 26*b* may be secured to the panel 10*b* in a manner similar to that described in U.S. patent application Ser. No. 09/570,618. Further description is also provided hereinbelow in conjunction with drawing FIGS. 5 and 6.

Referring further to FIGS. 2 and 3, in particular, each beam 30 is preferably characterized as a so-called C-channel member which is substantially coextensive with the overall length of the panel 10*b* but is dimensioned to provide clearance for movement of the door 10 between the guide tracks 18 or 20. The beam 30 shown in FIGS. 2 and 3, is supported on the panel 10*b* by securing the beam thereto using conventional self tapping hex-head washer faced screw fasteners 32, see FIG. 3, at selected ones of the stiles 24.

The beam 30 is also retained in assembly with the panel 10*b* and supported thereon by spaced apart support brackets 34 mounted on alternate ones of the stiles 24 on either side of the center stile and on the center stile. Preferably, each of the brackets 34 is, as shown in FIGS. 3 and 4, formed of folded metal plate including a generally rectangular web part 34*a* having approximately the same width as the width of the intermediate stiles 24. A stub flange 34*b* is formed integral with the web 34*a* and a second and more extensive flange 34*c* is also formed integral with the web 34*a* and extends generally parallel with the flange 34*b*. Flange 34*c* includes an upwardly extending beam locator projection 34*d* interposed beam support surfaces 34*e* and 34*f*. Flange 34*b* includes a support surface 34*g* which is coplanar with the surfaces 34*e* and 34*f*. The length of the locator projection 34*b* extending between the support services 34*e* and 34*f* is slightly less than the elongated opening or slot 31 formed in the beam 30. As shown in FIG. 3 by way of example each of the brackets 34 is secured to a stile 24 by a screw fastener 32 disposed generally in line with and below the screw fastener 32 which is used to secure the beam 30 to the stile 24.

Figure 5:
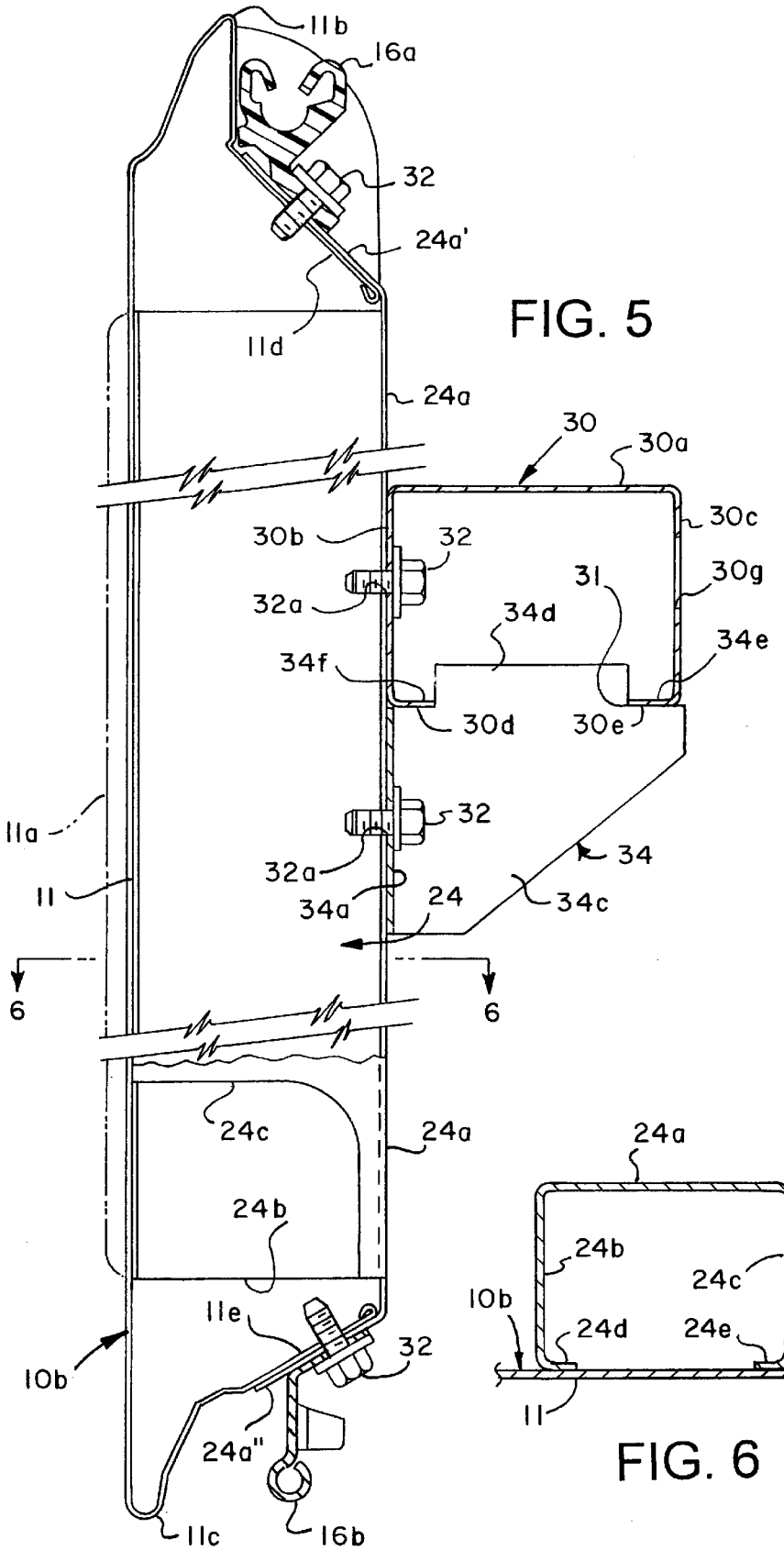
FIG. 5 is a section view taken generally along the line 5—5 of FIG. 2.

Referring now to FIG. 5, one preferred configuration of the door panel 10*b* is as shown wherein the panel is formed of folded metal sheet to provide an upper edge 11*b* and a lower edge 11*c*, the geometries of which are preferably but not required to be such as to provide a pinch resistant joint between door panels, as described in further detail in U.S. patent application Ser. No. 09/570,618. The folded metal sheet forming the panel 10*b* includes the front wall 11, the upper edge 11*b* and an inwardly sloping wall portion 11*d*. In like manner, the lower edge 11*c* is also contiguous with the front wall 11 and terminates at an inwardly sloping lower wall portion 11*e*.

Figure 6:
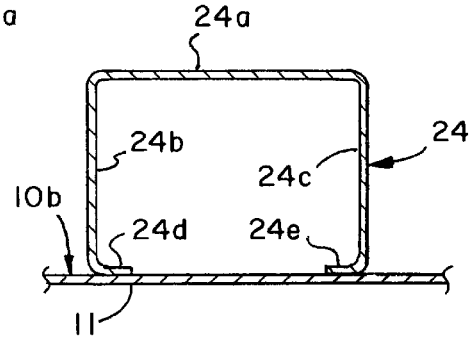
FIG. 6 is a section view taken along line 6—6 of FIG. 5.

Each stile 24 is preferably formed as a somewhat channel shaped member or so-called C-channel, see FIG. 6, having a web 24*a*, opposed parallel flanges 24*b* and 24*c* and in-turned flanges 24*d* and 24*e*, as illustrated. Flanges 24*d* and 24*e* are suitably secured to panel front wall 11 by an adhesive or other means known to those skilled in the art. As shown in FIG. 5, the web 24*a* extends beyond flanges 24*b* and 24*c* at opposite ends to form web extension portions 24*a*' and 24*a*" which are adapted to be contiguous with the wall portions lid and 11*e* and are secured thereto by respective fasteners 32, as shown. Panel hinge members 16*a* and 16*b* may also be secured to the panel 10*b* at the points of securements of the stile 24, as shown. Those skilled in the art will recognize that the specific configuration of the panel 10*b* is exemplary and that other panel configurations utilizing spaced apart stiles or other reinforcing means may be strengthened by the reinforcement system of the present invention.

Referring further to FIG. 5, each of the beams 30 is also preferably configured as so called C-channel, each having a web 30*a*, opposed parallel flanges 30*b* and 30*c* extending normal to the web 30*a* and distal in turned flange portions 30*d* and 30*e* which are shown resting on the surfaces 34*f* and 34*e*, respectively, of the respective support brackets 34. As previously mentioned, and as shown in FIG. 5, the projection 34*d* fits between the flanges 30*d* and 30*e* and is dimensioned to be only slightly less in length than the distance between the beam flanges, or width of slot 31. In this way the beam 30 is accurately located with respect to the stiles 24 and the panel 10*b* once it is placed in its working position shown in the drawing figures. Beam flange 30*c* preferably includes a clearance opening 30*g* for each of the fasteners 32 which, as shown in FIG. 5, secure the beam 30 to the stiles 24. Each of the brackets 34 is secured to the same stile by a fastener 32 also. As shown in the drawings, each beam 30 is mounted substantially contiguous with the webs 24*a* of the respective stiles 24 and as well as the corresponding webs of the end stiles 26*a* and 26*b*. As shown in FIG. 2, the beam 30 is preferably secured to the stiles 26*a* and 26*b*, also by fasteners 32.

One significant advantage of the panel reinforcing system of the present invention pertains to the ease with which the beams 30 may be mounted on the panels 10*a*, 10*b*, 10*c* and/or 10*d*. The beams 30 do not require to be mounted on each panel of a multi-panel sectional door, however, the overall strength and windload resistance of a door is improved if each panel is reinforced. Alternatively, depending on panel width and windload requirements, multiple spaced apart beams 30 may be mounted on each panel, if desired.

In accordance with a preferred method of installing the beams 30 on the panels 10*a*, 10*b*, 10*c* or 10*d* the panel to which a beam or beams 30 is to be secured is first mounted in the guide tracks 18 and 20 in the aforementioned doorway or opening in the wall 12 generally in the position shown in FIG. 1. As substantially a first step, the brackets 34 are located generally co-planar with each other and spaced apart on selected ones of stiles 24, as shown in FIG. 2, and are secured to the respective stiles in the positions shown in FIG. 2. Suitable measurements may be made from either edge 11*b* or 11*c* of the panel 10*b*, for example, to properly locate each of the brackets. The brackets are then secured to the respective stiles 24 by their respective fasteners 32. The beam 30 may then be installed on the panel 10*b*, for example, by lifting the beam and resting it on the brackets 24 in the position shown in the drawing figures. Thus, with the beam 30 supported by the brackets 24, self-tapping fasteners 32 may be applied to secure the beam 30 to each of the stiles 24, 26*a* and 26*b*.

If the fasteners 32 are not also self-drilling, suitable fastener pilot holes 32*a*, FIG. 5, are provided in the stiles 24 at the time of beam and bracket installation. Alternatively, the fastener pilot holes 32*a* may be provided at the time of fabrication of the door panels 10*a*, 10*b*, 10*c* and 10*d* to obviate the need for measuring the required locations of the beams and brackets at a later time. The method steps are, of course, repeated for installing a beam or beams 30 on each panel 10*a*, 10*b*, 10*c* and 10*d*, if desired, while each of the panels is mounted in the doorway and supported between the door guide tracks 18 and 20. In this way the weight of the components, namely the panel 10*b* and the beam 30, need not be dealt with collectively which would be the case if the beam 30 were assembled to the panel prior to placement of the panel in the doorway or door opening and supported between the guide tracks 18 and 20. Accordingly, handling of the panels 10*a*, 10*b*, 10*c* and 10*d* during transportation to the erection site and the erection of the door 10 is easier than would be the case if the beams 30 were preassembled to the panels.

Moreover, the configuration of the beams 30 is advantageous with regard to the stiffness of the beams and thus the increase in stiffness of the door panels 10*a*, 10*b*, 10*c* and 10*d*, once the beams have been assembled and secured thereto. However, other configurations of door reinforcing beams and accompanying brackets may be utilized in accordance with the invention. Another advantage of providing a reinforcing beam 30 having a generally channel shaped cross-sectional configuration, together with the configuration of the support brackets 34, is that the brackets themselves aid in increasing the stiffness of the beams. Conventional sheet metal materials may be used in constructing the beams 30 and the brackets 34 and, as mentioned previously, conventional self tapping washer faced hex-head screws, for example, may be used in securing the brackets and the beams to the door panels.

Figure 7:
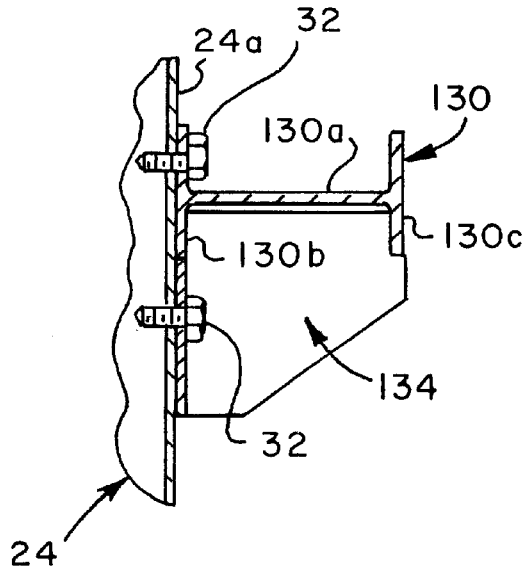
FIG. 7 is a detail section view similar to FIG. 5 showing one alternate beam and bracket configuration.

Referring briefly to FIG. 7, there is illustrated an alternate embodiment of a beam and bracket configuration for use with the door 10 and the door panels 10*a*, 10*b*, 10*c* and 10*d*, respectively. The reinforcing beam may, for example, be an I beam or an H beam. In FIG. 7, an I beam 130 is illustrated comprising a web 130*a* and opposed flanges 130*b* and 130*c*. The beam 130 is adapted to be supported by spaced apart brackets 134, one shown, similar to the brackets 34 but modified with respect to the geometry of the beam 130. The beam 130 and the brackets 134 are, of course, secured to respective stiles 24 by fasteners 32 in the same manner as shown and described previously for the beam 30 and the brackets 34.

Figure 8:
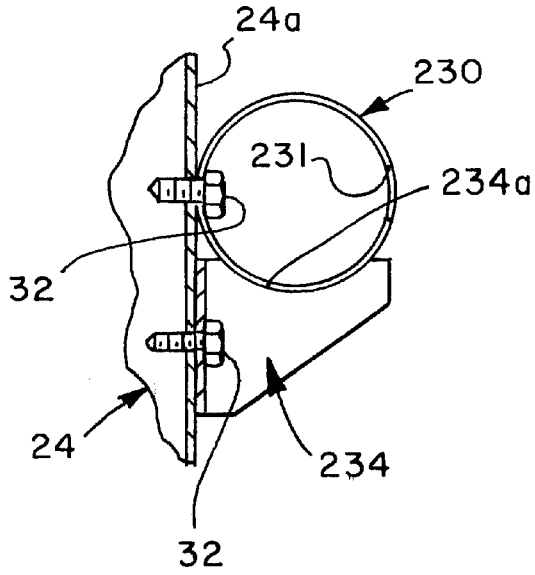
FIG. 8 is a detail section view similar to FIG. 5 showing another alternate beam and bracket configuration.

Still further, as shown in FIG. 8, the beam geometry may be a rectangular, square or cylindrical cross-section tubular member. A cylindrical tubular beam 230 is shown in FIG. 8 supported on spaced apart brackets 234, one shown. The brackets 234 may each be provided with an arcuate recess portion 234*a* for locating the beam 230 when it is first mounted on a door panel and positioned adjacent the stiles 24, one shown in FIG. 8. The beam 230 is provided with suitable spaced apart fastener clearance holes 231, one shown, to provide access for securing or removing fasteners 32, one shown, for securing the beam 230 to the respective stiles 24. Fasteners 32 are also, of course, used for securing the brackets 234 to the stiles 24.

Figure 9:
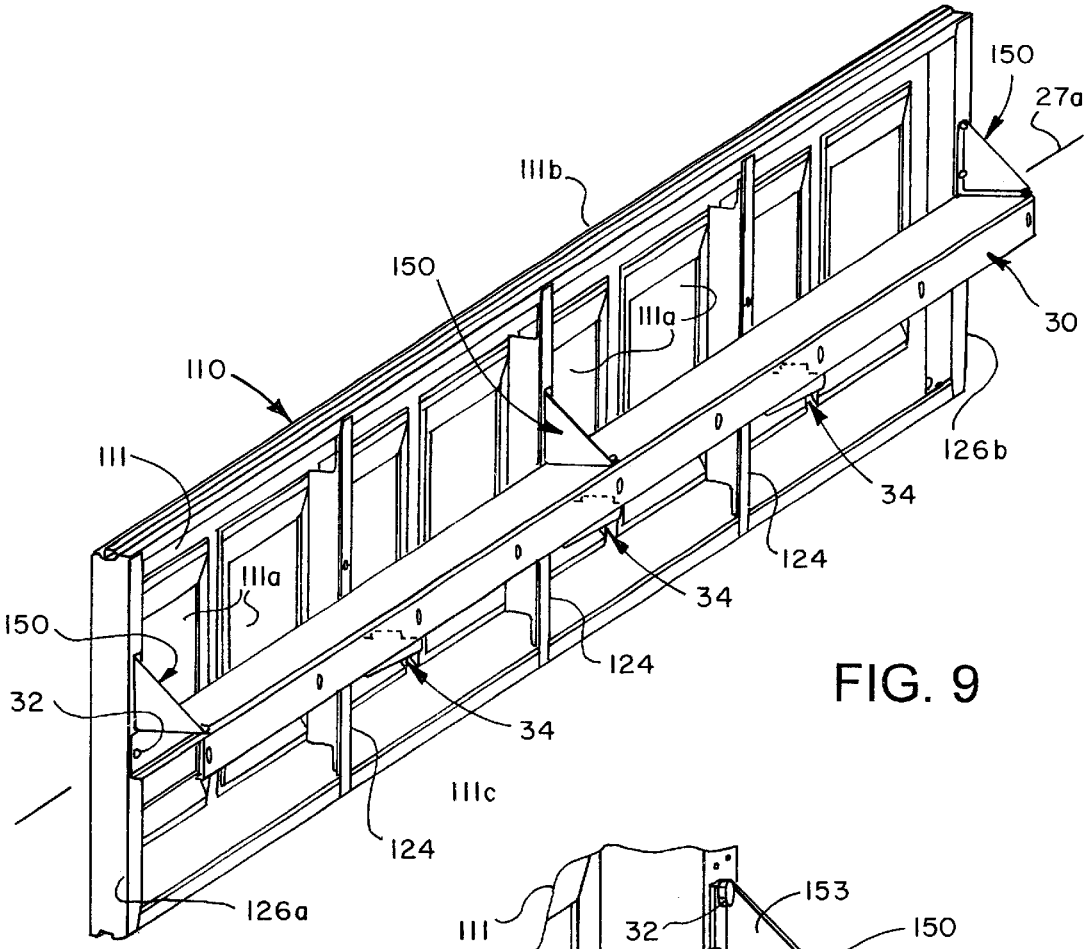
FIG. 9 is a perspective view of an alternate embodiment of a sectional garage door panel including a reinforcing beam system in accordance with the invention installed thereon.
Figure 10:
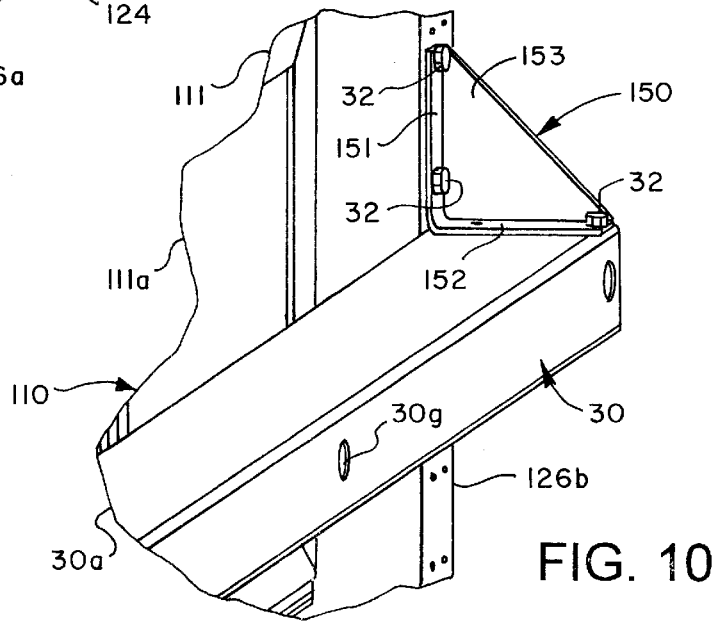
FIG. 10 is a detail perspective view on a larger scale of the beam system shown in FIG. 9 and illustrating the location of a beam anti-deflection gusset member installed thereon.

Referring now to FIGS. 9 and 10, an alternate embodiment of a sectional door panel is illustrated and designated by the numeral 110. Door panel 110 includes a longitudinal axis 27*a*, plural embossings 111*a* formed in a frontwall 111, a longitudinal top edge 111*b* and a longitudinal bottom edge 111*c*. Spaced apart intermediate vertical stiles 124, three shown, extend between the top and bottom edges 111*b* and 111*c*. Opposed end stiles 126*a* and 126*b* are also secured to the panel 110. Beam support brackets 34 are secured to the stiles 124 in the same manner that the support brackets are secured to the stiles 24 for the embodiment of FIGS. 1 through 6. The brackets 34 are shown in supportive relationship to a beam 30 which is suitably secured to each of the stiles 124, 126*a* and 126*b* by fasteners 32 in the same manner that a beam 30 is secured to one of the panels 10*a*, 10*b*, 10*c* or 10*d*.

However, the beam 30 mounted on the panel 110 is further reinforced by spaced apart gusset plates 150 which are secured to the beam 30 and to the end stiles 126*a*, 126*b* and the center intermediate stile 124. As shown in the detail view of FIG. 10, each of the gusset plates 150 includes an L-shaped right angle flange including flange parts 151 and 152 and a gusset plate part 153 coextensive with the flange parts 151 and 152 and extending normal thereto. Fasteners 32 secure the gusset plate 150 to the stiles 126*a*, 126*b* and 124 and to the beam 30, as indicated by way of example in FIG. 10. The flange parts 151 and 152 are of equal length to provide symmetry to the gusset plate 150 so that the plate may be installed facing in either direction, as indicated in FIG. 9. The gusset plates 150 may be used alone to support and reinforce the beam 30, if desired, but are secured to the web 30*a* of the beam to resist deflection or a somewhat rolling action of the beam about its own longitudinal axis when the panel 110 is undergoing deflection due to windloads and the like.

Figure 11:
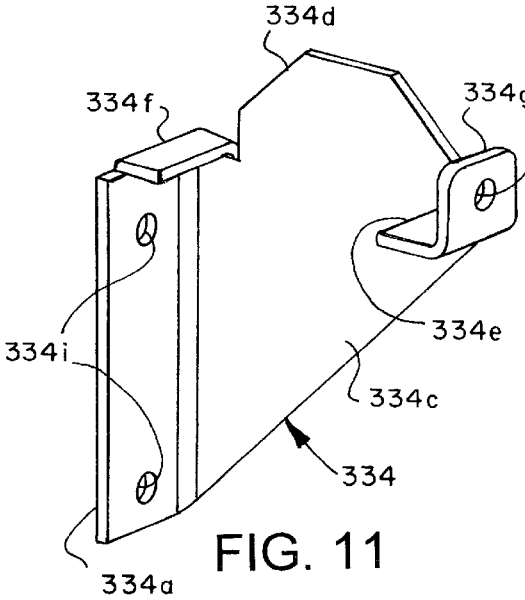
FIG. 11 is a perspective view of a third alternate embodiment of a support bracket for the support beam system of the present invention.

Referring now to FIG. 11, another embodiment of a support bracket for the reinforcement beam system of the invention is illustrated and generally designated by the numeral 334. Support bracket 334 includes a generally rectangular web 334*a* integrally formed with a flange 334*c* which projects normal to the web 334*a* and includes a projection 334*d* dimensioned to fit between the flanges 30*d* and 30*e* of a C-channel type beam 30, see FIG. 12 also. The support bracket 334 also includes spaced apart beam support tabs 334*e* and 334*f* which project in cantilever fashion from the plane of flange 334*c* and are integrally formed therewith. Support tab 334*e* also includes an upturned flange portion 334*g* having a suitable fastener receiving bore 334*h* formed therein. Cantilever support tabs 334*e* and 334*f* are coplanar. Web 334*a* includes spaced apart fastener receiving bores 334*i*, as shown in FIG. 11.

Figure 12:
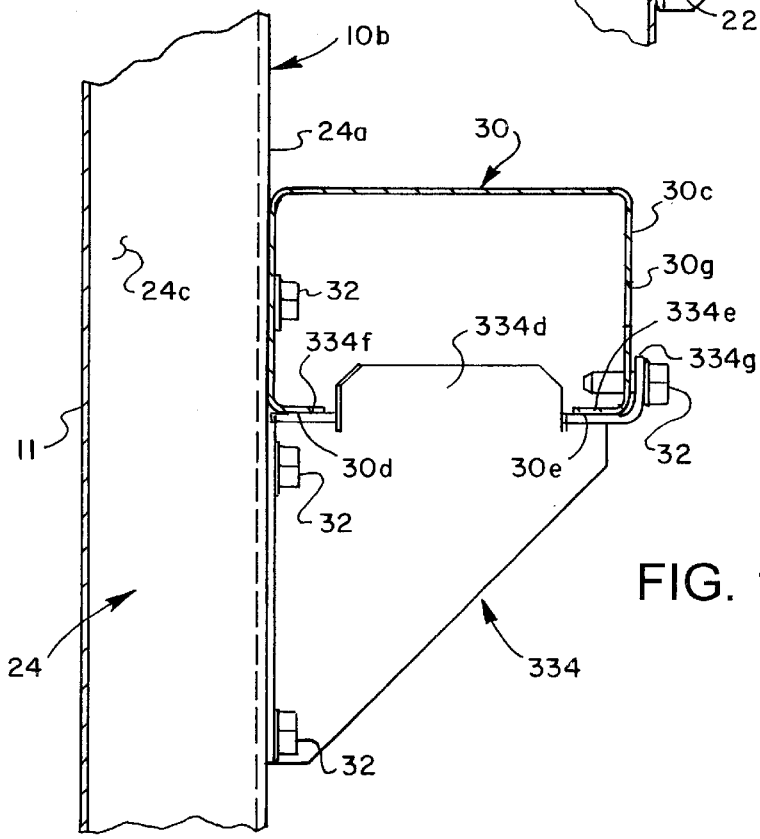
FIG. 12 is a side elevation, partially sectioned, showing the support bracket of FIG. 11 in a working position.

Referring to FIG. 12, support bracket 334 is shown in its working position secured to web 24*a* of a stile 24 by fasteners 32 in the same manner as the bracket 34. However, the support tabs 334*e* and 334*f* provide enhanced support for the inturned distal flange portions 30*d* and 30*e* of the beam 30, as shown in FIG. 12. Still further, a fastener 32 may be used to secure the flange 334*g* to the beam 30, as illustrated. The configuration of the support bracket 334 is useful in applications of the door panel reinforcement system wherein, with use of particularly long support beams 30, for example, the beams tend to twist or roll out of engagement with the support brackets under moderate to severe deflection of a door panel.

Figure 13:
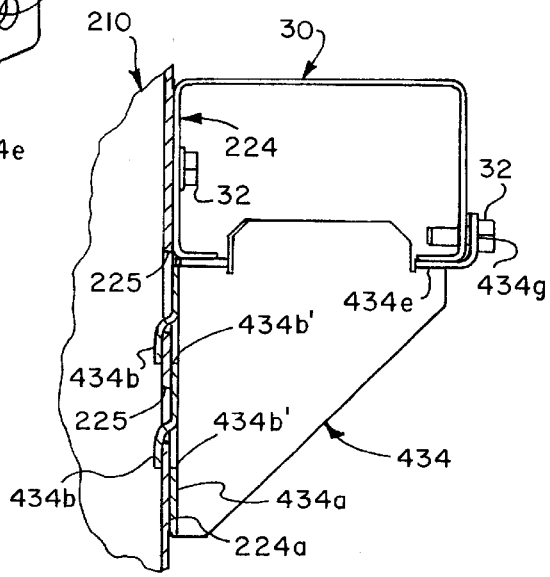
FIG. 13 is a side elevation, partially sectioned, of a fourth alternate embodiment of a support bracket for the support beam system of the present invention.

Referring now to FIG. 13, a further embodiment of a support bracket for use with the reinforcing beam system of the invention is illustrated and generally designated by the numeral 434. Bracket 434 is similar to bracket 334 except that a web 434*a* is provided with two laterally displaced tabs 434*b* which may be formed by a coining or punching operation on the web 434*a* to displace a portion of the metal of the flange into the configuration shown in FIG. 13. Corresponding openings 434*b*' are formed in the web 434*a* as a consequence of displacing the material of the web to form the tabs 434*b*.

A modified stile 224, similar to the stiles 24 or 26, is provided for a door panel 210 and for use with the support bracket or brackets 434 wherein a web 224*a* is provided with spaced apart slots 225 which are operable to receive the tabs 434*b*. Accordingly, the bracket 434 may be rapidly and securely mounted on the stile 224 by moving the bracket laterally with respect to the web 224*a* so that the tabs 434*b* project through the slots 225 and the bracket is then moved vertically downward, viewing FIG. 13, to engage the web 224*a* and secure the bracket to the stile 224. Fasteners 32 may be used to secure the beam 30 to the stile 224 and secure flange 434*g* of bracket tab 434*e* to the beam 30.

Figure 14:
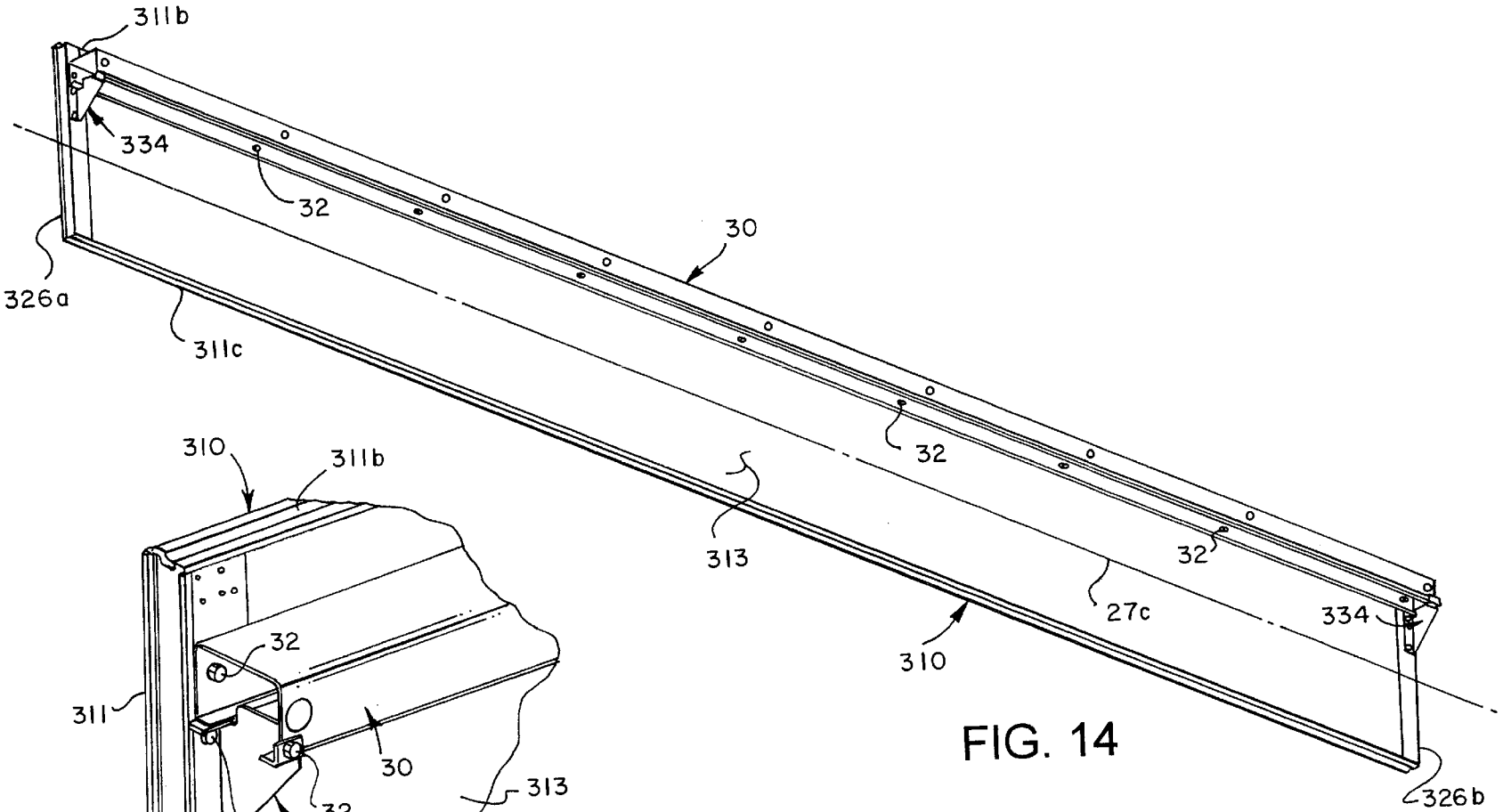
FIG. 14 is a perspective view of a reinforced door panel in accordance with yet another embodiment of the present invention.
Figure 15:
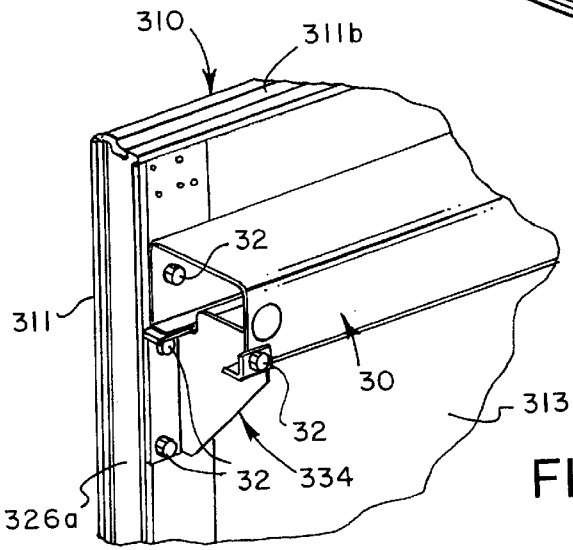
FIG. 15 is a view taken from a different perspective of a portion of the door panel shown in FIG. 14.

Referring now to FIGS. 14 and 15, another embodiment of a door panel in accordance with the invention is illustrated and generally designated by the numeral 310. The panel 310 includes a longitudinal central axis 27*c* and opposed end stiles 326*a* and 326*b*, an outer wall 311 and an inner wall 313. A space between the inner and outer walls may be filled with a suitable insulation material or the inner and outer walls may, in fact, be the surfaces of a solid panel member. If the door panel 310 is comprised of inner and outer sheet-like walls comprising the walls 313 and 311, these walls may be formed of sheet material such as wood, metal or plastic. The door panel 310 is reinforced by mounting support brackets 334 on the opposed end stiles 326*a* and 326*b* between top and bottom longitudinal panel edges 311*b* and 311*c*. The brackets 334 are secured to the opposed stiles, as indicated by way of example in FIG. 15, using fasteners 32. A beam 30 is mounted on the panel 310 supported by the brackets 334 in the manner as previously described for the embodiment shown in FIG. 12 and is secured to the brackets 334, respectively, by fasteners 32. The beam 30 is also secured to the end stiles 326*a* and 326*b* by respective fasteners 32, as shown by way of example in FIG. 15. Still further, the beam 30 may be secured to the panel wall 313 at spaced apart points therealong by fasteners 32, as shown in FIG. 14.

Accordingly, the reinforcement system of the present invention may be used with door panels which do not include one or more intermediate support or so-called stile members extending between the top and bottom edges of the panel. By relying primarily on support brackets, such as the brackets 334, attached to the panel at opposite ends by attaching the brackets to end stiles or to the inner wall of the door panel itself, and then further attaching the reinforcement beam to the inner wall of the door panel at spaced apart points therealong a panel without intermediate support members may be suitably reinforced.

Although preferred embodiments of a door reinforcement system and a method of installing same have been described in detail herein, those skilled in the art will recognize that various substitutions and modifications may be made without departing from the scope and spirit of the appended claims.

What is claimed is:

1. A reinforced sectional door panel comprising a panel front wall, a top edge, a bottom edge and at least two reinforcing stiles spaced apart on said panel and extending between said edges, respectively;

support brackets secured to said stiles, respectively, and adapted to locate and support a reinforcement beam thereon, respectively;

an elongated beam mounted on said brackets to reinforce said panel against deflection, said beam including a channel shaped cross section, a web, opposed flanges and respective distal flange portions extending toward each other and generally parallel to said web to form a substantially C-shaped cross section; and said support brackets each include a support surface thereon and a beam locating portion for locating said beam with respect to said stiles when said beam is placed on said support brackets, respectively.

2. A reinforced sectional door panel comprising a panel front wall, a top edge, a bottom edge and at least two reinforcing stiles spaced apart on said panel and extending between said edges, respectively;

support brackets secured to said stiles, respectively, and adapted to locate and support a reinforcement beam thereon, respectively;

an elongated beam mounted on said brackets to reinforce said panel against deflection, said beam including a channel shaped cross section;

said support brackets each include a support surface thereon and a beam locating portion for locating said beam with respect to said stiles when said beam is placed on said support brackets, respectively; and plural spaced apart gusset plates secured to said beam and to respective ones of said stiles, respectively, for resisting deflection of said beam.

3. A reinforced sectional door panel comprising a panel front wall, a top edge, a bottom edge and at least two reinforcing stiles spaced apart on said panel and extending between said edges, respectively;

support brackets secured to said stiles, respectively, and adapted to locate and support a reinforcement beam thereon, respectively;

an elongated beam mounted on said brackets to reinforce said panel against deflection, said beam including a channel shaped cross section, opposed flanges and clearance openings in one of said flanges for receiving a tool to engage a fastener for securing said beam to said stiles at the opposite one of said flanges; and said support brackets each include a support surface thereon and a beam locating portion for locating said beam with respect to said stiles when said beam is placed on said support brackets, respectively.

4. A reinforced sectional door panel comprising a panel front wall, a top edge, a bottom edge and at least two reinforcing stiles spaced apart on said panel and extending between said edges, respectively;

support brackets secured to said stiles, respectively, and adapted to locate and support a reinforcement beam thereon, respectively;

an elongated beam mounted on said brackets to reinforce said panel against deflection, said beam includes one of an I beam and an H beam cross-section; and said support brackets each include a support surface thereon and a beam locating portion for locating said beam with respect to said stiles when said beam is placed on said support brackets, respectively.

5. A reinforced sectional door panel comprising a panel front wall, a top edge, a bottom edge and at least two reinforcing stiles spaced apart on said panel and extending between said edges, respectively;

support brackets secured to said stiles, respectively, and adapted to locate and support a reinforcement beam thereon, respectively;

an elongated beam mounted on said brackets to reinforce said panel against deflection;

said support brackets each include a support surface thereon and a beam locating portion for locating said beam with respect to said stiles when said beam is placed on said support brackets, respectively; and said support brackets are secured to said stiles by cooperating tabs and slots in respective ones of said support brackets and said stiles.

6. A reinforced sectional door panel comprising a panel front wall, a top edge, a bottom edge and at least two reinforcing stiles spaced apart on said panel and extending between said edges, respectively;

support brackets secured to said stiles, respectively, and adapted to locate and support a reinforcement beam thereon, respectively;

an elongated beam mounted on said brackets to reinforce said panel against deflection;

said support brackets each include a support surface thereon and a beam locating portion for locating said beam with respect to said stiles when said beam is placed on said support brackets, respectively; and at least selected ones of said support brackets include spaced apart tabs formed thereon and defining spaced apart support surfaces for said beam.

7. The door panel set forth in claim 6 wherein:

at least one of said tabs is adapted to be secured to said beam with a mechanical fastener.

8. A reinforced panel for a sectional upward acting door, said panel comprising:

plural support brackets secured to said panel at spaced apart points thereon with respect to a longitudinal axis of said panel and adapted to locate and support a reinforcement beam thereon, respectively;

an elongated beam mounted on said support brackets;

said support brackets each include a support surface thereon and a beam locating portion for locating said beam with respect to a surface on said panel when said beam is placed on said support brackets, respectively; and spaced apart gusset plates secured to said panel and to said beam on a side of said beam opposite said support brackets for reinforcing said beam against deflection in response to windloads acting on said panel.

9. The door panel set forth in claim 8 wherein:

said gusset plates include opposed flange parts and a gusset plate part contiguous with and extending between said flange parts, said gusset plates being operable to be secured to said panel and to said beam by mechanical fasteners engaged with said flange parts, respectively.

10. The door panel set forth in claim 8 wherein:

said beam includes opposed flanges and a web extending between said flanges, one of said flanges is secured to said panel by mechanical fasteners and said gusset plates are secured to said beam at said web, respectively.

11. A method for installing a reinforcement system for sectional door panel, said door panel comprising a panel of a multi-panel sectional door, said door panel being adapted to be disposed between opposed guide members for forming a closure over a doorway formed in a wall, said method comprising the steps of:

placing said door panel in a predetermined position;

providing plural support brackets, each including plural spaced apart, substantially coplanar beam support surfaces and beam locating projections interposed said support surfaces, respectively;

securing said support brackets to said door panel, spaced apart and aligned with each other in a predetermined pattern on an inside of said door panel;

providing an elongated beam as a C-channel having opposed flanges and opposed distal flange portions extending toward each other and being substantially coplanar with each other;

mounting said beam on said brackets and adjacent said door panel and in engagement with said support surfaces and with said locating projections extending between said distal flange portions, respectively; and securing said beam to at least one of said brackets or said door panel at spaced apart points thereon.

12. The method set forth in claim 11 wherein:

said support surfaces on said brackets comprise spaced apart tabs projecting from a flange of said support brackets, respectively, at least one of said tabs on each of said brackets including a flange portion; and said method includes the step of securing said flange portion of said tabs, respectively, to said beam.

13. A method for installing a reinforcement system for a sectional door panel, said door panel comprising a panel of a multi-panel sectional door, said door panel being adapted to be disposed between opposed guide members for forming a closure over a doorway formed in a wall, said method comprising the steps of:

placing said door panel in a predetermined position;

securing plural spaced apart support brackets to said door panel, said brackets being aligned with each other in a predetermined pattern on an inside of said door panel, each of said brackets including a beam support surface formed thereon;

mounting an elongated beam on said brackets and adjacent said door panel;

securing said beam to at least one of said brackets or said door panel at spaced apart points thereon; and providing plural gusset plates and securing said gusset plates to said beam and said panel at spaced apart points thereon.

14. A sectional door panel for an upward acting door, said panel comprising a panel front wall, a top edge, a bottom edge and opposed side edges, at least two reinforcing stiles spaced apart on said panel and extending between said top and bottom edges, respectively, said panel being reinforced against deflection of said front wall by windloads acting thereon, said panel including:

an elongated beam adapted to be mounted on said panel and extending substantially between said side edges for reinforcing said panel against said deflection; and beam support brackets secured to said stiles, respectively for locating and supporting said beam thereon, respectively, said support brackets each including a support surface thereon for receiving and supporting said beam in supportive relationship by placing said beam on said support brackets, respectively, and said support brackets each further including a beam locating portion for locating said beam in a predetermined position with respect to said stiles when said beam is placed on said support brackets, respectively.

15. The panel set forth in claim 14 wherein:

said beam includes a configuration selected from a group consisting of a channel-shaped cross section, an I-beam shaped cross shaped section, an H-beam shaped cross section, a C-shaped cross section, and a tubular cross section.

16. The panel set forth in claim 14 wherein:

said support surfaces on said brackets extend substantially horizontally when said brackets are installed on said stiles and said panel is disposed in a doorway at a vertical wall.

* * * * *